US005781935A

United States Patent [19]

Bassett et al.

[11] Patent Number: 5,781,935

[45] Date of Patent: Jul. 21, 1998

[54] PADDED BODY PROTECTION PADS

[76] Inventors: Aldean B. Bassett, 4200 Community Dr., Apt. #2404, West Palm Beach, Fla. 33409; Nicole Durr, 1491 N. Ocean Blvd., Palm Beach, Fla. 33480

[21] Appl. No.: 728,155

[22] Filed: Oct. 9, 1996

[51] Int. Cl.[6] ..... A41D 13/06; A41D 13/08; A41D 27/12; A41D 27/26

[52] U.S. Cl. ..... 2/455; 2/465; 2/23; 2/24; 2/16; 2/267; 2/268

[58] Field of Search ..... 2/463, 464, 465, 2/46, 22, 23, 24, 16, 267, 271, 268, 455, 456

[56] References Cited

U.S. PATENT DOCUMENTS

| | | | |
|---|---|---|---|
| 2,266,886 | 12/1941 | McCoy | 2/22 |
| 2,696,005 | 12/1954 | Schaumer | 2/267 |
| 3,044,075 | 7/1962 | Rawlings | 2/267 |
| 3,259,910 | 7/1966 | Daignault | 2/24 |
| 4,120,052 | 10/1978 | Butler | 2/16 |
| 4,441,211 | 4/1984 | Donzis | 2/463 |
| 4,756,026 | 7/1988 | Pierce, Jr. | 2/16 |
| 4,800,119 | 1/1989 | Kolar | 428/283 |
| 5,423,087 | 6/1995 | Krent et al. | 2/267 |
| 5,477,558 | 12/1995 | Volker et al. | 2/24 |

*Primary Examiner*—Jeanette E. Chapman
*Attorney, Agent, or Firm*—McHale & Slavin

[57] ABSTRACT

An improved body protection pad which can be formed to protect a variety of body parts from impact, constructed with a rigid central layer and having a soft outer covering which absorbs impacts and disperses energy. This softer outer layer protects the wearer of the pad, as well as protects the impacting object or person. An inner cushioning layer is also provided between the pad wearer and the rigid central layer. An abrasion resistant coating can also be added over the soft covering. When used for contact sports such as football, this pad construction is effective in preventing injuries resulting when the pad is used as a striking object. The covering may be applied in segmented pieces or as a continuous layer over both sides of the rigid central layer. The central layer can be solid or can form a frame-like structure.

8 Claims, 2 Drawing Sheets

PADDED BODY PROTECTION PADS

FIELD OF INVENTION

This invention relates to body protection pads for sporting activities which provides a hard central layer for maximum impact protection of the user, but presents a soft outer layer to lessen damaging impacts with other participants of the sporting activity.

BACKGROUND OF THE INVENTION

Many contact sports produce injuries due to collisions between participants, commonly referred to as players, despite the donning of padding by the players. Common contact sports which utilize player padding include football, hockey, lacrosse, basketball, baseball, and soccer. Besides a variety of helmets, players also wear body pads which are designed to protect the player from injuries resulting from external impact. Pads shield areas such as the shoulders, elbows, forearms, hands, hips, tailbone, thighs, knees, and shins.

Known prior art pads employ a hard outer shell or casing with a soft internal cushion lining. While the lining is designed to absorb impact forces and protect the pad wearing player, an opposing player often comes in direct contact with the hard outer shell of the pad. If the opposing player impacts the hard outer shell in an unprotected area, the shell might cause serious damage to the player. This is particularly true for shoulder pads which include sharp-edged hard plastic appendages. Consequently, many such pads including the elbow, forearm, and shoulder pads are used by players as an offensive weapon.

Another problem with a hard outer casing on a pad is the lack of shock protection against impacts with other hard objects. The inner padding layer absorbs the forward shock of the pad wearer and prevents contact of the wearer with the hard casing. However, the dangerous jolt that results from two hard objects colliding is not prevented and such forces are transmitted to the pad wearer.

Accordingly, what is needed is a body part protection pad which provides a hard central layer and soft inner padding to protect the pad wearer, but also provides a soft-outer padding to protect other players from impact with the hard central layer. The outer layer would protect the wearer from impact shock which would result from an exposed hard casing contacting another hard object. The outer padding might be formed and attached in pieces to facilitate covering various contours of the body pad. An outer abrasion resistant layer might also be added to the outer padding layer to seal and protect the pad.

SUMMARY OF THE INVENTION

The present invention teaches an improved impact protection pad which incorporates a unique energy absorbent material secured to the outer surface of a rigid central layer structure of the pad. The central layer structure can be solid or of a framed or webbed construction. The pad would be attached to various body parts via elastic or attachable straps or the like. Each pad would be made of a conventional shape for its application such as a knee or elbow pad. The inner surface of the hard central layer would be padded and covered in order to provide a comfortable fit for the user. The energy absorbent material is preferably a memory rubber such as vinyl nitrile sponge (VNS) being a combination of thermoplastic poly vinyl chloride and synthetic elastomer nitrile. The VNS covering can be further coated providing abrasion resistance and allowing for cosmetic effects. In this manner, the size and shape of pads so constructed can remain the same as previous pads.

The energy absorbing properties of the pads provide protection to the pad wearer and further operates to reduce the impact force of the pad when contacting another object. In this manner, if a pad wearing participant struck an unprotected area of another player, the pad provides a level of protection in the form of padding for both players. For instance, if a hockey player wearing an elbow pad strikes the unprotected facial area of another player, the outer coating material will absorb a portion of the shock, thereby lessening damage to the facial area. These energy absorbing properties are doubled when two players impact along a pad position, such as shoulder pads during a football game, because each player's pads has the energy absorbing coating.

Accordingly, it is an objective of the present invention to provide a body protection pad with a soft, energy absorbent covering or coating on its outer surfaces.

Still another objective of the present invention is to provide a body protection pad which is lighter and safer than pads currently employed.

It is a related objective of the present invention to provide a layered protection scheme for a user's body part which includes a hard central layer structure with a layer of soft, energy absorbent covering on the central layer's inner and outer surfaces.

It is a related objective of the present invention to provide a body protection pad with a soft, energy absorbent material molded around an inner web of structural support material.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
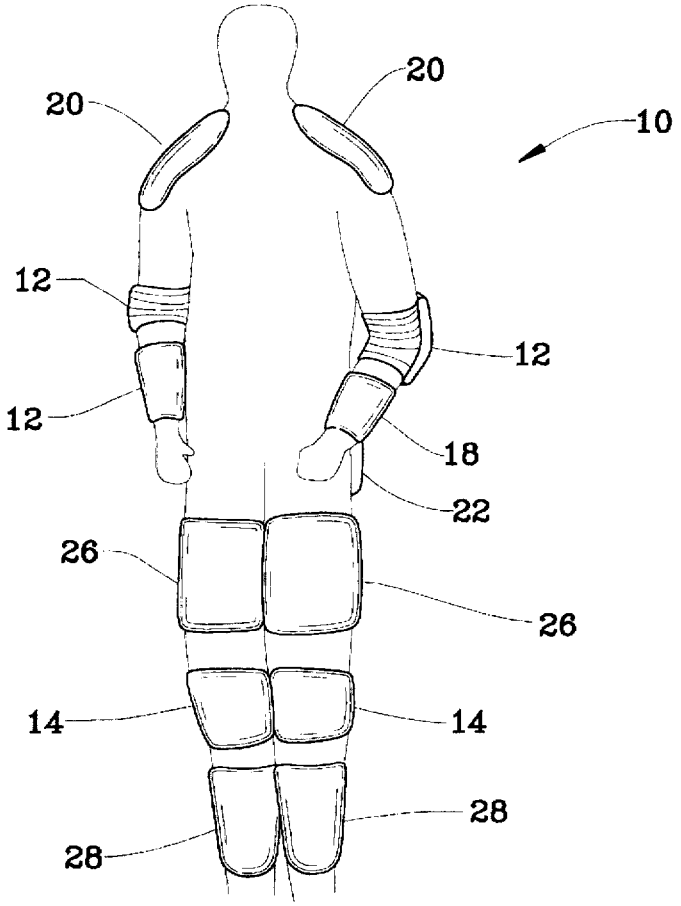
FIG. 1 shows a human figure with pads distributed across various points on the body which might be padded for protection against impact.

Referring now to FIG. 1, a human FIG. 10 is shown with pads worn on various parts of the body. The most common application for pads of the present invention would include, for instance, elbow pads 12, knee pads 14, and shoulder pads 16. Such pads frequently make contact with unprotected portions of another player's body, and therefore would benefit greatly from the outer protective layer. Other areas of the body would also benefit from similarly constructed pads. Such pads include forearm pads 18, shoulder pads 20, hip pads 22, tailbone pad, thigh pads 26, and shin pads 28.

Figure 2:
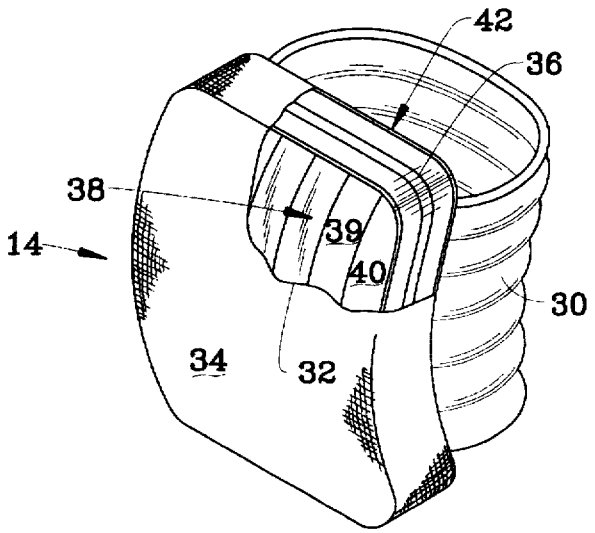
FIG. 2 shows an example knee pad with a cutaway of the outer coating layer to show the VNS layer attached to the outer surface of the hard central layer structure.

Referring now to FIG. 2, a knee pad 14 of the preferred embodiment is shown which incorporates an elastic band or attachable strap 30 for fixably holding the pad 14. An outer abrasion resistant coating 34 is applied across the front and outer surface of the pad 14. A cutaway section 32 of the coating 34 reveals the inner construction of the pad 14. A hard central layer structure 36 can be either flat or shaped to conform to a body part such as the knee. A layer of energy absorbing material 38, typically VNS, is attached or formed across the face of the central layer 36. The material 38 might be applied in sections or strips as shown in order to facilitate any knee-type curvature existing in the central layer structure 36. An inner protective layer 42 is applied across the back surface of the central layer 36 to further absorb impact forces and to comfortably shield the wearer from contact with the central layer structure 36.

Figure 3:
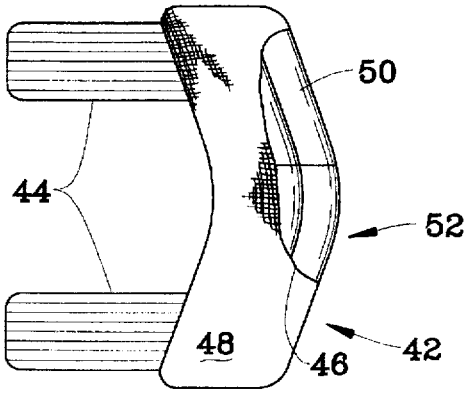
FIG. 3 shows an example elbow pad with a cutaway of the outer coating layer to show the VNS layer attached to the outer surface of the hard central layer structure.

Referring now to FIG. 3, an example elbow pad 42 is shown with a pair of elastic bands or attachment straps 44. A cutaway section 46 of the outer abrasion resistant coating 48 reveals sections 50 of outer protective layer 52. The inner and outer protective layers may be attached in sections to facilitate attachment around contours, or in single pieces which might be independently formed to fit over such contours.

Figure 4:
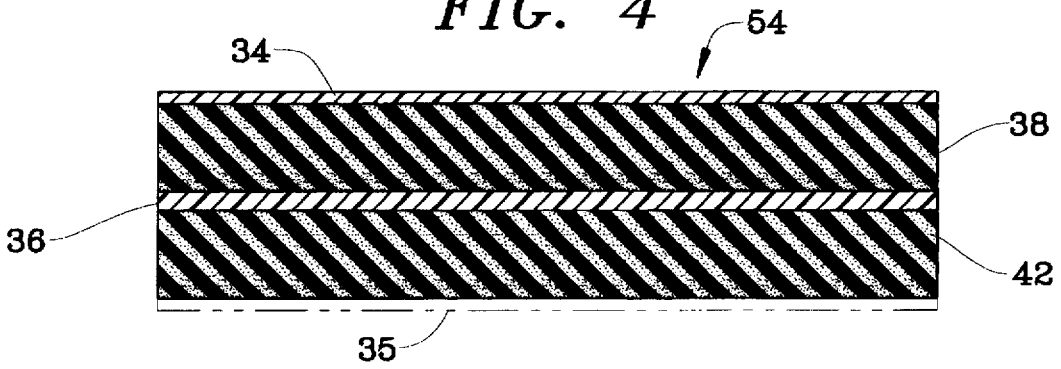
FIG. 4 shows a cross sectional view of the layered construction form the pad of FIG. 2.

Referring now to FIG. 4, a cross sectional view 54 of a body protective pad of FIG. 2 is shown. The center of the pad incorporates the hard central layer structure 36. The outer protective layer 38 is attached to the outside or upper surface. The inner protective layer 42 is attached to the inside or lower surface. Both layers 38 and 42 might typically be formed from ½ inch thick sections or sheets of Rubatex brand VNS which is cut to shape and bonded to the outside of the lightweight polycarbonate central layer structure. The outer abrasion resistant coating 34 is spray coated, or moldably applied, across the front surface of the pad. If the VNS material is sectionally applied, then the coating serves to provide a smooth exterior surface, rather than a jointed one. The smooth exterior surface might be further painted with teflon or other friction-resistant coatings to fend off the impact of glancing blows to the pad. The coating 34, which is extremely durable and water resistant might also be applied across all exposed surfaces, e.g. outer coating 34 as well as inner coating 35 shown in fathom. By fully coating the pad, all surfaces would be sealed and impervious to such external penetrants as water and sweat.

Figure 5:
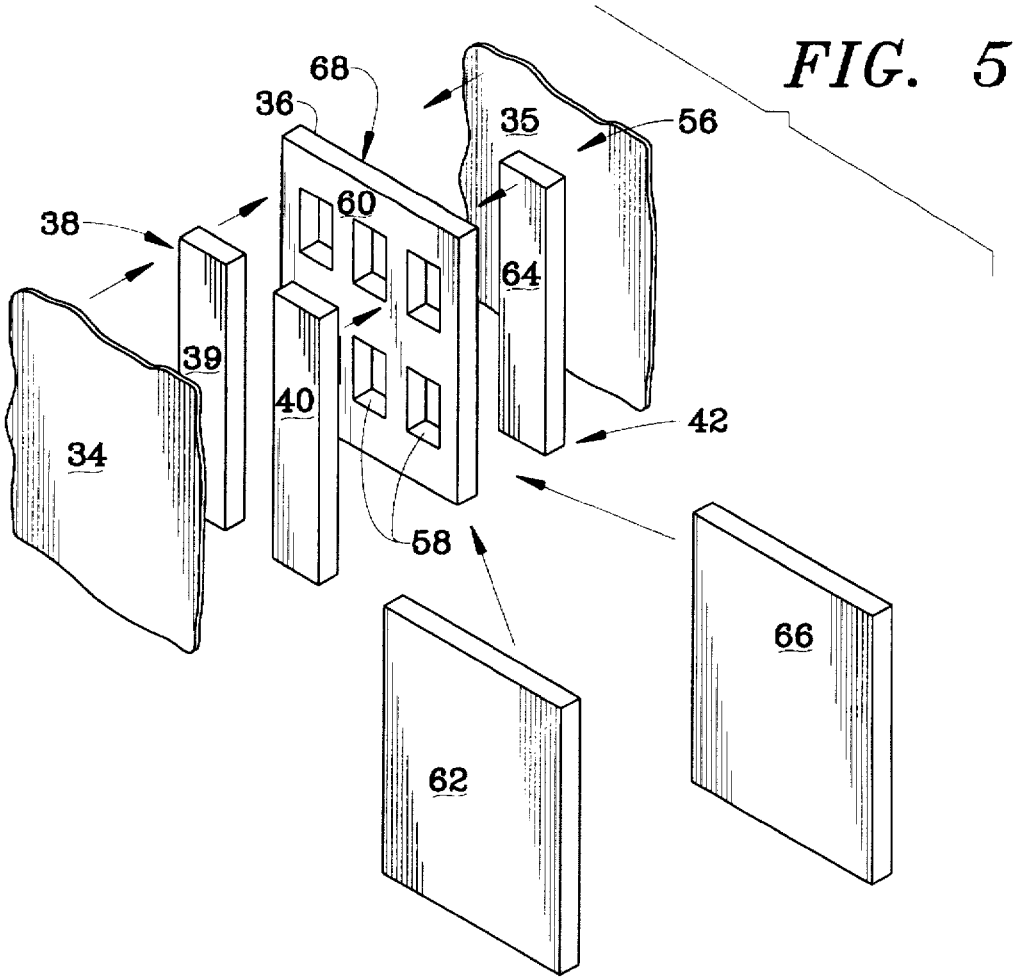
FIG. 5 shows an exploded view of the layered construction forming a pad.

Referring now to FIG. 5, an exploded view 56 of the layers of a pad such as 14 are shown. The central layer structure 36 might be constructed from a solid piece of rigid or semi-rigid material such as plastic or steel. This example shows a central layer structure 36 with a series of holes or cutouts 58 through its surface. These holes 58 create a frame or web-type structure which is lighter in weight and yet still extremely durable. Sections 62 and/or strips 39 and 40 are shown being attached to the front surface 60 of the central layer structure 36 to form the outer protective layer 38. Sections 66 and/or strips 64 are also attached to the back surface 68 of the hard central layer structure 36. The outer coating 34 is then formed or attached across the outer protective layer 38. An inner coating 35 might also be formed or attached across the inner protective layer 42. As mentioned previously, the formation process for the coatings 34 and 35 might be used to sealably encase the entire layered construct 36, 38, and 42. Such coatings include urethane which proves to be an effective surface for resisting abrasions and for providing environmental resistance to elements such as water, sweat, snow, sunlight, etc.

Additionally, certain pads might require cutouts for ventilation or attachment of accessories. Such cutouts could be added to the pad through the various layers 34, 35, 36, 38, and 42. Additionally such cutouts could be preformed and aligned in the layering before assembly.

It is to be understood that while a certain form or forms of the invention are illustrated, it is not to be limited to the specific forms or arrangements of parts herein described and shown. It will be apparent to those skilled in the art that various changes may be made without departing from the scope of the invention and the invention is not to be considered limited to what is shown in the drawings and descriptions.

What is claimed is:

1. A body protection pad for attachment to a body part to be protected from impact, said pad comprising: a hard central layer structure with an inner and outer surface; an outer covering means formed from interconnecting preshaped pieces of vinyl nitrile sponge material being approximately ½ inch thick and attached to said outer surface of said structure, said outer surface of said vinyl nitrile sponge material including an abrasion resistant coating; an inner covering means formed from a soft resilient material and secured to said inner surface of said structure and forming a cushion positioned between said structure and the wearer.

2. The body protection pad according to claim 1 wherein said abrasion resistant coating is urethane.

3. The body protection pad according to claim 1 wherein said structure is a one piece plastic layer.

4. The body protection pad according to claim 1 wherein said structure is a one piece metal layer.

5. The body protection pad according to claim 3 wherein said structure is perforated forming a web shape configuration.

6. The body protection pad according to claim 1 including a means for securing at least one attachment strap.

7. A body protection pad for attachment to a body part to be protected from impact, said pad comprising: a hard central layer having an inner and outer surface; a first protective layer covering said outer surface of said shell formed from preshaped pieces of vinyl nitrile sponge foam which are assembled and permanently secured to said outer surface of said center layer for directly absorbing impacts; a second protective layer covering said first layer for inhibiting abrasions to said first coating; a cushioning layer constructed from preshaped Pieces of vinyl nitrile sponge foam permanently secured to said inner surface of said center layer for providing a soft barrier between said hard shell and the wearer's body; and an abrasion resistant material placed on an outer surface of said first protective layer.

8. The helmet according to claim 7 wherein said abrasion resistant material is urethane.

* * * * *